US009414632B1

(12) United States Patent
Dougherty et al.

(10) Patent No.: US 9,414,632 B1
(45) Date of Patent: Aug. 16, 2016

(54) CONCUSSION PREVENTION HELMET

(71) Applicants: Philip Dougherty, Portland, OR (US); Joni Carlson, Portland, OR (US)

(72) Inventors: Philip Dougherty, Portland, OR (US); Joni Carlson, Portland, OR (US)

( * ) Notice: Subject to any disclaimer, the term of this patent is extended or adjusted under 35 U.S.C. 154(b) by 0 days.

(21) Appl. No.: 14/729,746

(22) Filed: Jun. 3, 2015

(51) Int. Cl.
*A42B 3/00* (2006.01)
*A42B 3/06* (2006.01)

(52) U.S. Cl.
CPC ..... *A42B 3/003* (2013.01); *A42B 3/069* (2013.01)

(58) Field of Classification Search
CPC ..... A42B 3/127; A42B 3/00; A42B 3/069; A42B 3/12; A42B 3/046; A42B 1/22; A42B 3/003; A42B 3/04; A42B 3/121; A42B 3/125; A61F 13/00
USPC ..... 2/410, 425, 411–413
See application file for complete search history.

(56) References Cited

U.S. PATENT DOCUMENTS 4,096,227 A * 6/1978 Gore ..... B01D 71/36 264/110
5,397,628 A * 3/1995 Crawley ..... A41D 31/0038 428/314.4
5,471,906 A * 12/1995 Bachner, Jr. ..... F41H 1/02 109/49.5
5,947,918 A * 9/1999 Jones ..... A63B 71/085 128/859
6,282,724 B1 * 9/2001 Abraham ..... A41D 13/015 2/267
7,254,843 B2 * 8/2007 Talluri ..... A42B 3/063 2/411
8,776,272 B1 * 7/2014 Straus ..... A42B 3/003 2/411
8,826,468 B2 * 9/2014 Harris ..... A42B 3/127 2/411
9,107,466 B2 * 8/2015 Hoying ..... A42B 3/069

* cited by examiner

*Primary Examiner* — Gloria Hale
(74) *Attorney, Agent, or Firm* — Antonio Papageorgiou, Esq.; Meister Seelig & Fein LLP

(57) ABSTRACT

A helmet accessory is provided, the helmet having an outer surface shaped to cover at least a portion of a user's head, the accessory including a first layer disposed over the shell of the helmet, the first layer having a coefficient of friction less than the coefficient of friction of the outer surface of the shell.

18 Claims, 1 Drawing Sheet

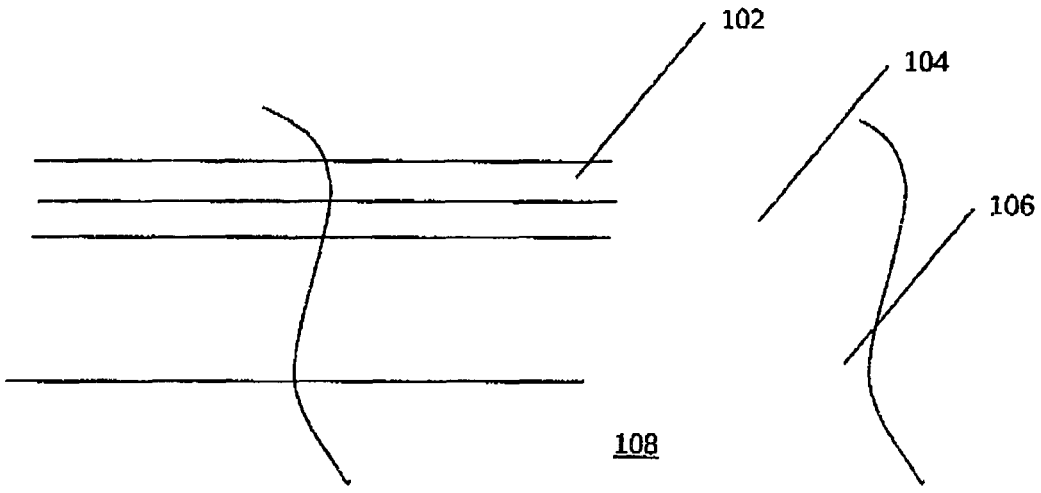
102
104
106
108

CONCUSSION PREVENTION HELMET

BACKGROUND OF THE INVENTION

The present application relates to helmets and more particularly to helmets for use in sporting events and competitions.

Several types of helmets exist for a variety of sports uses, but many exhibit at least one or more limitations/disadvantages. For example, current football helmets will transfer the impact of a collision to the human brain inside the helmet such that concussions are a frequent result of a head collision. Generally, it is understood that impact is the product of time and force. Although current football helmets provide a barrier between the head and the source of the impact, they do not reduce either the time of contact or the size of the force. Accordingly, there is a need for helmets that are not so limited.

SUMMARY OF THE INVENTION

A helmet accessory is provided with the helmet having an outer surface shaped to cover at least a portion of a user's head, the accessory including a first layer disposed over the shell of the helmet and the first layer having a coefficient of friction less than the coefficient of friction of the outer surface of the shell.

In at least one embodiment, the accessory includes a second layer disposed between the first layer and the shell of the helmet, wherein the second layer is bound to the first layer so that the second layer provides a reinforcement to the first layer.

In at least one embodiment, the second layer is at least one of a sheet and a fabric.

In at least one embodiment, the second layer is a synthetic material.

In at least one embodiment, the accessory includes a third layer disposed between the first layer and the shell of the helmet, wherein the third layer is made with an energy absorbing material.

In at least one embodiment, the first layer is formed directly onto the third layer.

In at least one embodiment, the accessory includes a second layer disposed between the first layer and the third layer, wherein the second layer is bound to the first layer for the second layer to provide reinforcement to the first layer.

In at least one embodiment, the first layer has a coefficient of friction less than 0.08.

In at least one embodiment, the first layer is a PTFE coating.

In at least one embodiment, the first layer is a PTFE coating have a low cure temperature.

In at least one embodiment, the first layer has a thickness of about 20 um.

In at least one embodiment, the first layer is a fluoropolymer coating.

In at least one embodiment, the first layer is a silicone coating.

In at least one embodiment, the first layer is a surfactant coating.

In at least one embodiment, the accessory includes a third layer disposed between the first layer and the shell of the helmet, wherein the third layer is made with an energy absorbing material and wherein the first and second layer are formed as a unit to be removably attached to the helmet.

In at least one embodiment, the accessory includes a third layer disposed between the first layer and the shell of the helmet, wherein the third layer is made with an energy absorbing material and wherein the first and second layer are formed directly onto the helmet.

In at least one embodiment, the accessory includes at least one of a second and third layer having a indicia displayed outwardly thereon, and wherein the first layer is transparent for the indicia to be visible through the first layer.

In at least one embodiment, the accessory includes a third layer disposed between the first layer and the shell of the helmet, wherein the third layer is made with an energy absorbing material having a thickness between about 0.25 inches to about 1 inch thick.

In another aspect, a helmet accessory is provided, the helmet having an outer surface shaped to cover at least a portion of a user's head, the accessory including: a first layer disposed over the shell of the helmet, the first layer having a coefficient of friction a coefficient of friction less than 0.08; and a third layer disposed between the first layer and the shell of the helmet, wherein the third layer is made with an energy absorbing material having a thickness between about 0.25 inches to about 1 inch thick and wherein the first and second layer are formed as a unit to be removably attached to the helmet. Additional aspects of the present invention will be apparent in view of the description which follows.

BRIEF DESCRIPTION OF THE FIGURES

FIG. 1 is a cross section of a helmet/helmet cover, according to at least one embodiment of the inventions discussed herein.

DETAILED DESCRIPTION OF THE INVENTION

The present application therefore provides a helmet or other sports equipment that reduces the intensity of an impact, thereby reducing the likelihood of a concussion. In this regard, the inventive helmet/helmet accessory reduces either or both of the magnitude of the force and the time of contact, which in turn reduces the impact and consequently the shaking of the brain that result in a concussion. This is generally achieved with a coating or covering over the helmet that reduces the friction between it and the object that the helmet comes into contact with. This coating is preferably a slick/slippery material that is applied to the outside surface of the helmet or to a helmet accessory worn over the helmet. This coating can be made of a number of substances, as will be described in detail below. Moreover, the force of the impact may be reduced by the addition of a layer of an energy absorbing material, such as polyurethane or similar substance, on the outside of the helmet between the coating and the outer surface of the helmet. The compression of this layer may absorb some of the force before it is transmitted to the inside of the helmet. In at least one embodiment, the coating/layer of energy absorbing material is adhered directly over the hard shell of the helmet. Alternatively, the coating/layer of energy absorbing material may be a helmet cover that is applied over the shell of a helmet.

Referring to FIG. 1, the helmet accessory according to at least one embodiment of the present application includes at least one of first layer 102, a second layer 104, and a third layer 106 disposed over the shell of a helmet 108. The first layer 102 is generally a material with a coefficient of friction lower than that of the shell of the helmet 108 in order to reduce the time that of an impact on the helmet. The second layer 104 is an optional binding layer that provides reinforcing to the first layer. The second layer 104 may be a sheet and/or woven from any natural or synthetic material. For example, the second layer 104 may be a woven nylon fabric that the first layer 102 is adhered to for reinforcement.

The first layer 102 may be may be a substance like polytetrafluoroethylene or other low-friction coating that is applied over the second 104 or third 106 layers, or the outer surface of the helmet 108. A very thin ~20 um polytetrafluoroethylene coating may be sufficient to provide a slippery surface that would not significantly affect the flexibility of the underlying layers. Similarly, silicone or fluoropolymers with the desired flexibility and coefficient of friction may also be used. polytetrafluoroethylene is not the material with the lowest coefficient of friction (0.05-0.08)—other materials may have better properties in terms of coefficient of friction, such as carbon coatings. However, some of these are quite expensive and would put the helmet out of the price range of consumers. One of the things that sets polytetrafluoroethylene apart from the other materials is that it its frictional coefficient actually decreases as the load increases, which makes it very suitable for high-impact sports. Another benefit of polytetrafluoroethylene is that it is commercially available, and the technology needed for applying coatings is already in place. As indicated herein, a surfactant may be sprayed onto the second or third layers. The surfactant may need to be reapplied periodically. A dry coating may be used as well.

Considering the feasibility of actually manufacturing polytetrafluoroethylene on polyurethane. Polytetrafluoroethylene is usually applied to metals, and needs to undergo a curing process at a relatively high temperature. It looks like polyurethane can start to thermally degrade as low as 150 C if held at that temperature for an extended time, but it shouldn't melt because it is a thermoset polymer. In this instance, polytetrafluoroethylene with a low cure temperature may be used.

The third layer 106 may be any energy absorbing material, such as polyurethane or any energy absorbing foam. The third layer 106 may be adhered to the outer surface of the helmet 108 or it may be removably attachable to the helmet, for example, ties, snaps, VELCRO® or hook and loop fastener, etc. In this regard, the helmet cover reduces the force by adding a layer of energy material to the outside of the helmet, which would partially absorb shock from an impact with material outside the helmet from any angle. The helmet cover further reduces the time variable of intensity by adding a friction-reducing layer. That is, the helmet having the reduced friction layer will slide, for example, on the ground, off another helmet or another player in considerably less time than the current helmet models. This has the added benefit of making attempted tackles using the helmet less effective and so less frequent.

To summarize, the combination of the slick surface and padding outside the helmet reduces the risk of concussions in athletes far more effectively than the current hard shell helmets having only internal padding. In this regard, the first layer on the outside of the helmet should be flexible and sufficiently slippery. The first layer may also be either transparent or be able to hold words, colors, or other indicia, as part of the football uniform team identification. If the first layer is clear, the words or colors formed/printed onto the second or third layers can show through the first layer.

The product may be formed in a variety of ways. First, the second or third layer may be in the form of a sheet cut in a foldable pattern to fit on and around the helmet. In this instance, the first layer, e.g., a surfactant, may be sprayed or painted onto one side of the sheet. The sheet can then be formed around an existing football helmet and glued, snapped or tied into place. Second, as helmets are manufactured, the third layer may be molded onto the outside of the helmet and then sprayed with the first layer, e.g., the surfactant. This could be done by depositing the third layer by dipping, spraying or painting the third layer onto the helmet, then spraying the low-friction first layer with school colors mixed into the coating. Other insignia can be painted onto the low-friction coating by etching the surface in the shape of the insignia, then spraying the insignia on as a second layer of low-friction coating which only sticks to the etched areas.

The third layer, e.g., polyurethane layer, may be between 0.25 inches and 1 inch thick with about 0.5 inches as the optimum to reduce the weight and bulk. The first layer coating adds only negligible weight. A collision between helmets with a slick surface and an external foam layer would greatly reduce the shock and the consequent impact on the human brain. The foam could be configured to different thicknesses on various parts of the helmet based on how often those parts of the helmet are impacted during a typical football game. The thickness and location of the foam/slick layer may be varied to provide protection against hard surface to helmet collision in, e.g., hockey, military, bicycle riding, motorcycle riding, auto racing or other applications where impact to the helmeted head could cause a concussion.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A helmet accessory attached to a helmet having an outer surface shaped to cover at least a portion of a user's head, the accessory comprising:

a first layer disposed over a shell of the helmet, the first layer having a coefficient of friction less than a coefficient of friction of the outer surface of the shell; and a third layer disposed between the first layer and the shell of the helmet, wherein the third layer is made with an energy absorbing material and wherein the first layer and a second layer are formed as a unit to be removably attached to the helmet.

2. The accessory of claim 1, comprising the second layer disposed between the first layer and the shell of the helmet, wherein the second layer is adhered to the first layer for the second layer to provide reinforcement to the first layer.

3. The accessory of claim 2, wherein the second layer is at least one of a sheet and a fabric.

4. The accessory of claim 3, wherein the second layer is a synthetic material.

5. The accessory of claim 1, comprising the third layer disposed between the first layer and an outside of the shell of the helmet.

6. The accessory of claim 5, wherein the first layer is formed directly onto the third layer.

7. The accessory of claim 5, comprising the second layer disposed between the first layer and the third layer, wherein the second layer is adhered to the first layer for the second layer to provide reinforcement to the first layer.

8. The accessory of claim 1, wherein the first layer has a coefficient of friction less than 0.08.

9. The accessory of claim 1, wherein the first layer is a PTFE coating.

10. The accessory of claim 9, wherein the first layer is a PTFE coating have a low cure temperature.

11. The accessory of claim 1, wherein the first layer has a thickness of about 20 um.

12. The accessory of claim 1, wherein the first layer is a fluoropolymer coating.

13. The accessory of claim 1, wherein the first layer is a silicone coating.

14. The accessory of claim 1, wherein the first layer is a surfactant coating.

15. The accessory of claim 1, wherein the first and second layers are formed directly onto the helmet.

16. The accessory of claim 1, comprising at least one of the second and third layers having an indicia displayed outwardly thereon, and wherein the first layer is transparent for the indicia to be visible through the first layer.

17. The accessory of claim 1, wherein the third layer is made with an energy absorbing material having a thickness between about 0.25 inches to about 1 inch thick.

18. A helmet accessory attached to a helmet having an outer surface shaped to cover at least a portion of a user's head, the accessory comprising:

a first layer disposed over a shell of the helmet, the first layer having a coefficient of friction less than 0.08; and a third layer disposed between the first layer and the shell of the helmet, wherein the third layer is made with an energy absorbing material having a thickness between about 0.25 inches to about 1 inch thick and wherein the first layer and a second layer are formed as a unit to be removably attached to the helmet.

* * * * *